US005379679A

United States Patent [19]

Falter et al.

[11] Patent Number: 5,379,679

[45] Date of Patent: Jan. 10, 1995

[54] ACUTATOR WITH SERIES ARRANGED CONTROL VALVES

[75] Inventors: Ronald C. Falter; Robert Broucksou, both of Columbia, S.C.

[73] Assignee: Cooper Industries, Inc., Houston, Tex.

[21] Appl. No.: 867,254

[22] Filed: Apr. 10, 1992

[51] Int. Cl.[6] ..... F15B 11/08

[52] U.S. Cl. ..... 91/424; 91/448; 91/468; 91/442; 91/462

[58] Field of Search ..... 91/424, 445, 448, 468, 91/444, 442; 137/596

[56] References Cited

U.S. PATENT DOCUMENTS

| | | | |
|---|---|---|---|
| 2,230,145 | 1/1941 | Lechler | 91/424 X |
| 2,341,696 | 2/1944 | Davis | 91/448 X |
| 2,482,280 | 9/1949 | Lerma | 91/424 X |
| 2,589,019 | 3/1952 | Neuroth | 91/424 X |
| 2,598,907 | 6/1952 | Griffin | 91/424 |
| 2,974,637 | 3/1961 | Holmes et al. | 91/424 X |
| 2,986,121 | 5/1961 | Nowack | 91/424 |
| 4,098,288 | 7/1978 | Waxham | 137/596 |
| 4,149,381 | 4/1979 | Mekler . | |
| 4,577,407 | 3/1986 | Hahn . | |
| 4,706,548 | 11/1987 | Baldauf et al. | 91/424 |
| 4,748,896 | 6/1988 | Ott et al. | 91/461 X |
| 4,949,461 | 8/1990 | van der Merwe et al. | 30/245 |
| 4,967,474 | 11/1990 | Wells | 30/228 X |

FOREIGN PATENT DOCUMENTS

| | | |
|---|---|---|
| 1226050 | 9/1966 | Germany . |
| 2824890 | 6/1978 | Germany . |
| 3529802 | 8/1985 | Germany . |

*Primary Examiner*—Edward K. Look
*Assistant Examiner*—John Ryznic
*Attorney, Agent, or Firm*—Nelson A. Blish; Eddie E. Scott

[57] ABSTRACT

The present invention comprises a double acting actuator having a piston movable within a cylinder, a main poppet control valve connected to a fluid pressure source, and first and second poppet valves connected in series to a rod side chamber of the cylinder. The piston is extended upon actuation of both first and second poppet valves, while allowing retraction of the piston upon release of either the first or the second poppet valves.

10 Claims, 12 Drawing Sheets

ACUTATOR WITH SERIES ARRANGED CONTROL VALVES

BACKGROUND OF THE INVENTION

The present invention pertains to pneumatic power tools; more particularly, the present invention pertains to air operated single stroke tools.

In many different types of factories it is required that workers use single stroke tools such as scissors or shears, wire clamp crimpers or pliers to open up spring formed hose clamps. Continuous repetitive manual operation of scissors or shears, crimpers or pliers causes great discomfort in the hand and forearm. To ease the discomfort of manually operating single stroke tools for long periods of time a need has developed for an air power unit to operate single stroke tools. One example of such need is in the poultry industry where shears are used by processors to cut apart chicken bodies.

The remainder of the specification will address scissors or shears as an exemplary use of the power unit of the present invention. It will be understood; however, that the pneumatic power unit of the present invention may be used with a broad variety of single stroke tools.

Power operated scissors or shears are disclosed in U.S. Pat. No. 4,967,474. While this patent represents an advance in the art, the described hand-held power operated shears have been found to be difficult to operate and sometimes dangerous. The need remains, therefore, for air powered shears which are both comfortable for the operator and provide a high degree of safety; while at the same time, reducing fatigue on the muscles which control the operators fingers which in turn control tool operation.

SUMMARY OF THE INVENTION

A pneumatic power unit for hand-held shears includes three, three-way valves, as follows: a main valve, a first remote thumb actuated valve and a second remote finger actuated valve. The main valve and the two remote valves form a control system for the piston and cylinder assembly, which strokes the blade portion of the shears. The interconnection of the three, three-way valves requires that the operator depress both the first and second remote valves to make the scissor blades close.

BRIEF DESCRIPTION OF THE DRAWINGS

A better understanding of the pneumatic power unit of the present invention may be had by reference to the drawings, wherein.

DESCRIPTION OF THE EMBODIMENTS

Figures 1, 2:
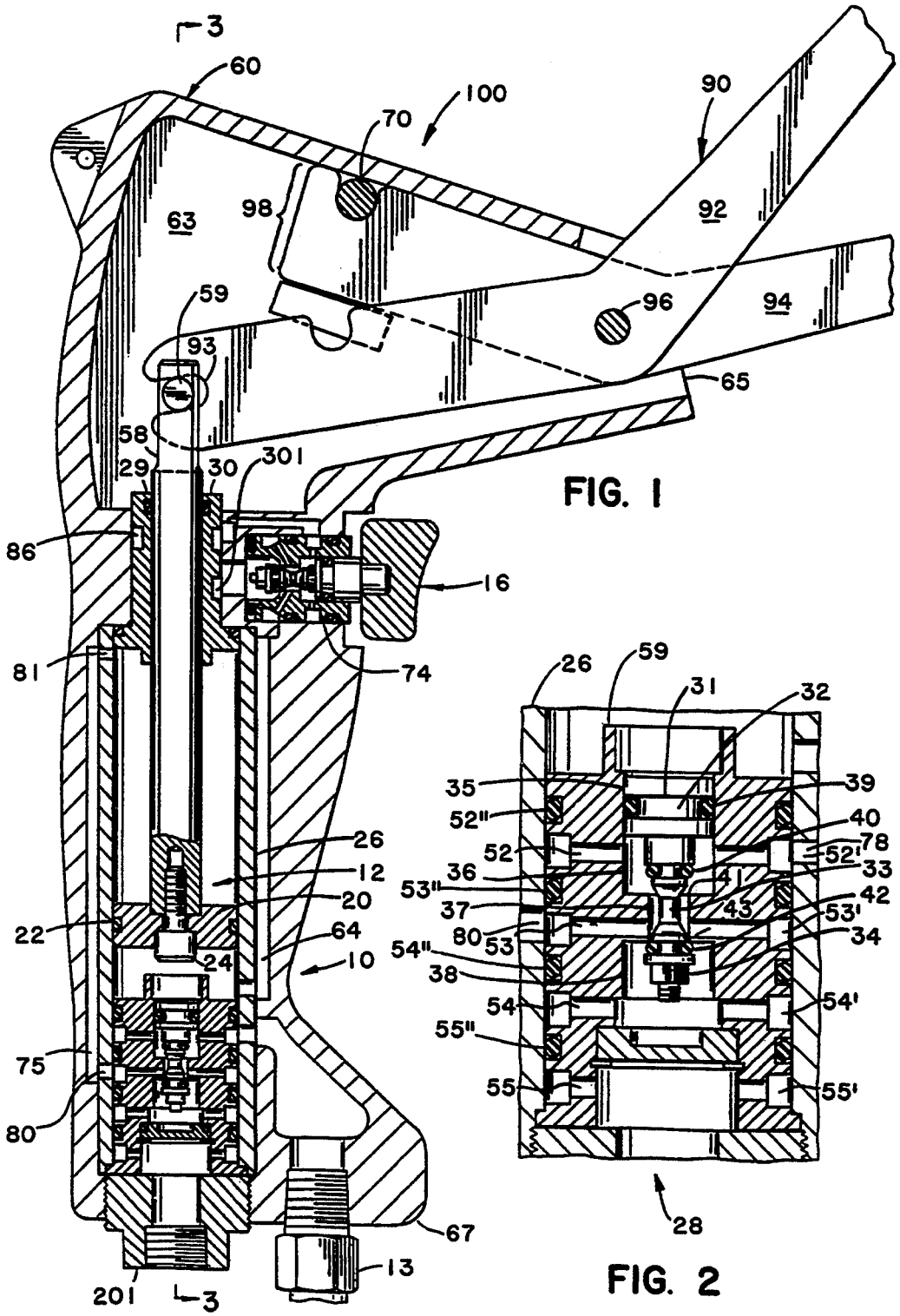
FIG. 1 is a front elevational view in partial section of the pneumatically operated ergonomic shears of the present invention.
FIG. 2 is an enlarged view in partial section of the poppet valve assembly used in the main valve.
Figure 3:
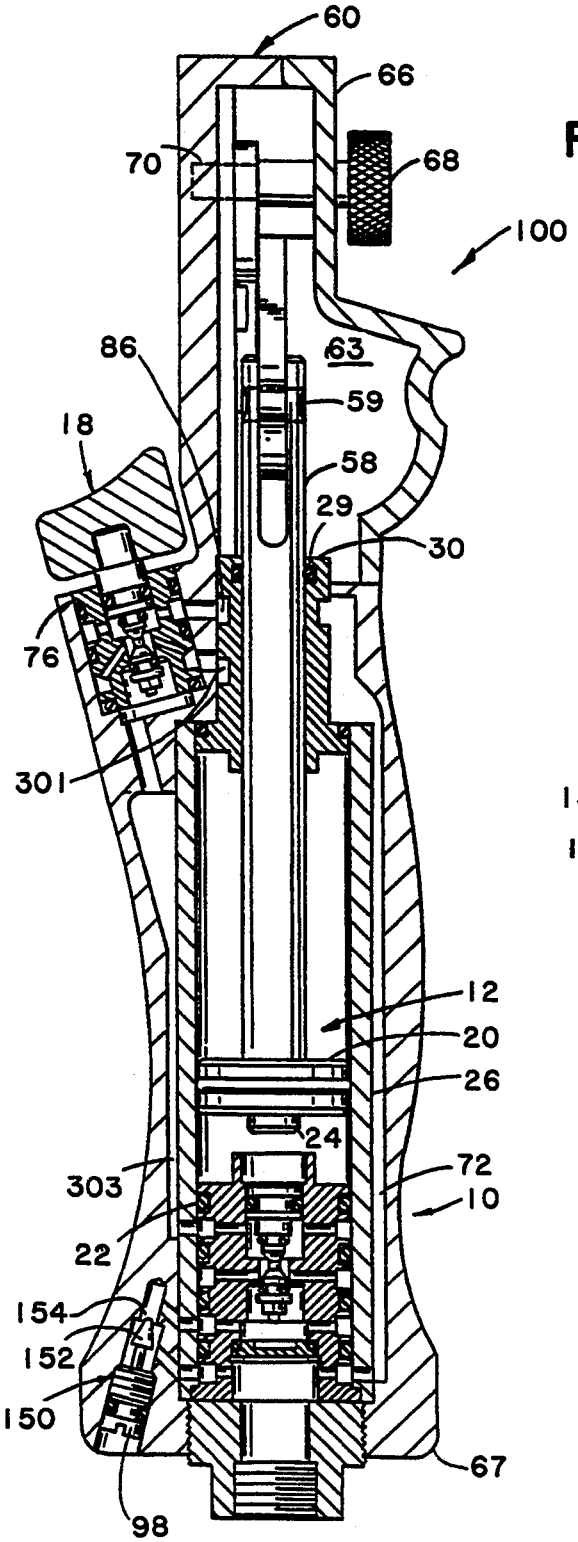
FIG. 3 is a rear elevational view in partial section at line 33 of FIG. 1 illustrating the main valve, the flow control valve and the thumb actuated valve.

As shown in FIGS. 1 and 3, the pneumatic shears 100 of the present invention consist of three main components. First is blade assembly 90. Second is housing assembly 60 and third is air flow control system 10.

Blade assembly 90 includes a moving blade 92, a stationary blade 94, a hinge or pivot point 96. Moving blade 92 includes a U-shaped opening 93 at its rearward end. This opening 93 is used to engage with pin 59 which extends from a moving shaft 58. The rear end of stationary blade 94 is nested in slot 98 in the housing assembly 60 to prevent it from rotating about pivot point 96. As previously mentioned, a variety of tools such as crimpers and pliers can be used in the place of scissor assembly 90.

The front portion of scissor assembly 90 is familiar to those acquainted with hand held scissors. The only departure from the construction of hand-held scissors is the rear portion of the scissor assembly 90 behind pivot point 96. This rear portion has been adapted to fit within upper cavity 63 in housing assembly 60. It is the rear portion of blade assembly 90 that enables air powered operation.

Figure 1A:
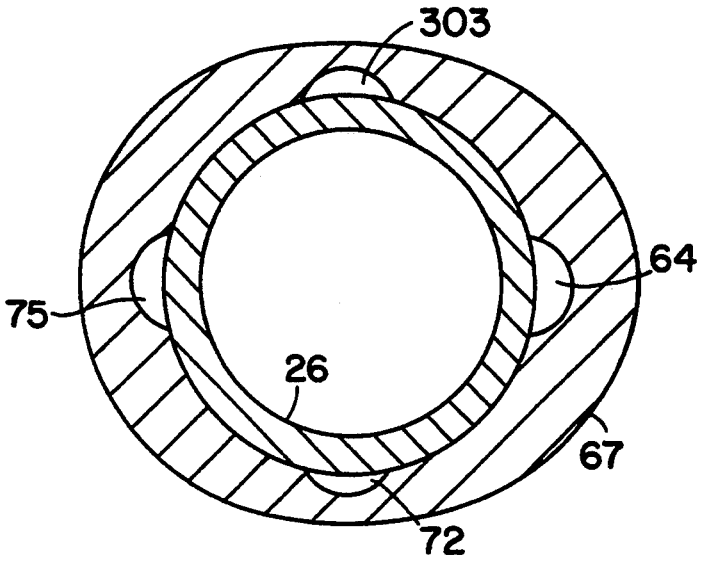
FIG. 1A is a cross sectional view taken at line A—A in FIG. 1.

Housing assembly 60 defines cavity 63 in which the rear portion of blade assembly 90 is contained. To prevent dust, dirt and debris from interfering with the operation of blade assembly 90, cavity 63 is closed by cover 66 (FIG. 3). Cover 66 is held in place by thumb screw 68 which threadably engages 70 housing assembly 60. Opening 65 permits the operative portion of blade assembly 90 to extend outwardly from cavity 63. Also formed within housing assembly 60 are air passages 72, 303, 75 and 64. These air passages are narrow, long, longitudinal channels adjacent to the cylinder 26 and sealed from each other as seen in FIG. 1A. At the base of pistol grip 67 is a fitting 13 for connection to a source of high pressure air and port 201 for exhaust air. Also provided within housing assembly 60 is substantially horizontal cylindrical space 74 which mounts finger actuated valve assembly 16 and a substantially upright cylindrical space 76 which mounts thumb actuated valve assembly 18.

Air flow control system 10 has five parts: the piston and cylinder assembly 12, finger actuated valve assembly 16, thumb actuated valve assembly 18, main valve assembly 28 and the optional speed control valve 150. Valves 28, 16 and 18 in the air flow control system 10 govern the operation of piston and cylinder assembly 12 and thus the opening and closing of blade assembly 90. As previously mentioned, a single stroke tool is disclosed. Depressing the triggers on both valves 16 and 18 causes the scissor assembly 90 to close. Release of the trigger on either valve 16 or 18 causes scissor assembly 90 to open.

Included within piston and cylinder assembly 12 is piston 20. Piston 20 is surrounded by o-ring 22 (not shown in FIGS. 5–13) to slidingly seal against the inside of cylinder sleeve 26. Piston 20 is connected to moving shaft 58 by threaded fastener 24.

Movement of piston 20 within cylinder sleeve 26 causes moving shaft 58 to travel in an upward and downward direction. This upward and downward movement of shaft 58 causes pin 59 to also move in an upward and downward direction. Pin 59 slides within u-shaped opening 93 and causes moving blade 92 to both pivot around point 96 and to move up and down with respect to stationary blade 94.

As previously stated, main valve assembly 28, finger actuated valve assembly 16 and thumb actuated valve assembly 18 govern the operation of piston and cylinder assembly 12. A better understanding of the construction of valve assemblies 28, 16 and 18 will become apparent from FIGS. 2, 2A and 4, respectively.

Giving specific attention to FIG. 2 which is an enlarged view of main valve assembly 28, a central poppet 31 is shown. Central poppet 31 has three portions as follows: upper portion 32, central portion 33 and lower portion 34. Central poppet 31 moves within passageway 35. Passageway 35 consists of upper passage 36, central passage 37 and lower passage 38. Surrounding upper portion 32 of central poppet 31 is o-ring 39 which assures slidable sealing engagement of upper portion 32 of central poppet 31 with the walls of the upper portion 36 of passageway 35. Surrounding central portion 33 of central poppet 31 is o-ring 40. O-ring 40 assures a sealing engagement with shoulder 41 formed at the intersection of upper portion 36 of passageway 35 and central portion 37 of passageway 35. Also surrounding central portion 33 of central spool 31 is o-ring 42 which engages shoulder 43 formed at the intersection of the lower portion 38 of passageway 35 with central portion 37 of passageway 35.

Acting on poppet 31 is air from ports 78 and 80 as well as air from the bottom of cylinder sleeve 26. Port 80 opens into the central portion 37 of passageway 35. Port 78 opens into the upper portion 36 of passageway 35. In the valve position shown in FIGS. 1 and 2, pressurized air may pass through port 78, through the central portion 37 of passageway 35 and thence through port 80. As may be shown in FIG. 1, air exiting port 80 flows through air passage 75 along cylinder sleeve 26 where it may then flow through port 81 into the top of cylinder sleeve 26.

As may be seen in FIG. 2, passageway 35 is formed in a valve housing body 59 with drilled holes 52, 53, 54, and 55 communicating from passageway 35 to annular grooves 52', 53', 54', and 55' on the outer circumference of valve housing body 59. Annular grooves 52', 53', 54', and 55' are separated from each other by O-ring seals 52'', 53'', 54'' and 55''.

Figure 4:
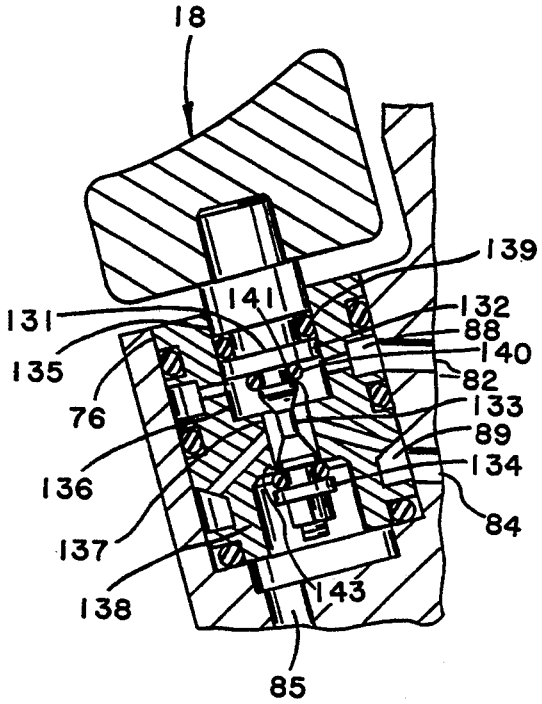
FIG. 4 is an enlarged view in partial section of the poppet valve assembly used in the thumb actuated valve.

Finger activated valve assembly 16 and thumb actuated valve assembly 18 are constructed for operation in effectively the same way. As shown in FIG. 4, thumb actuated valve assembly 18 includes a central poppet 131. Central poppet 131 has an upper portion 132, a central portion 133 and lower portion 134. Central poppet 131 moves within a passageway 135 which has upper portion 136, central portion 137 and lower portion 138.

Surrounding the upper portion 132 of central poppet 131 is o-ring 139 which provides sealing against the walls of upper portion 136 of passageway 135. O-ring 140 provides sealing against shoulder 141 formed between the upper portion 136 of passageway 135 and the central portion 137 of passageway 135. O-ring 142 provides sealing against shoulder 143 formed between lower portion 138 of passageway 135 and central portion 137 of passageway 135. Air is allowed to flow through thumb actuated valve assembly 18 through ports 85, 84 and 82. Port 82 is in fluid communication with passage 64 outside of cylinder sleeve 26 by means of annular groove 86. Ports 82 and 84 are in fluid communication with circular passageways 88 and 89 respectively. Port 84 is in fluid communication with lower portion 238 of finger actuated valve 16 by means of 90° arc groove 301 and air passage 302. Annular groove 86 and 90° arc groove 301 are formed around sleeve bearing 30 which guides the travel of moving shaft 58. Sleeve bearing 30 mounts within the top of cylinder sleeve 26. Sealing around shaft 58 is provided by o-ring 29.

Figure 2A:
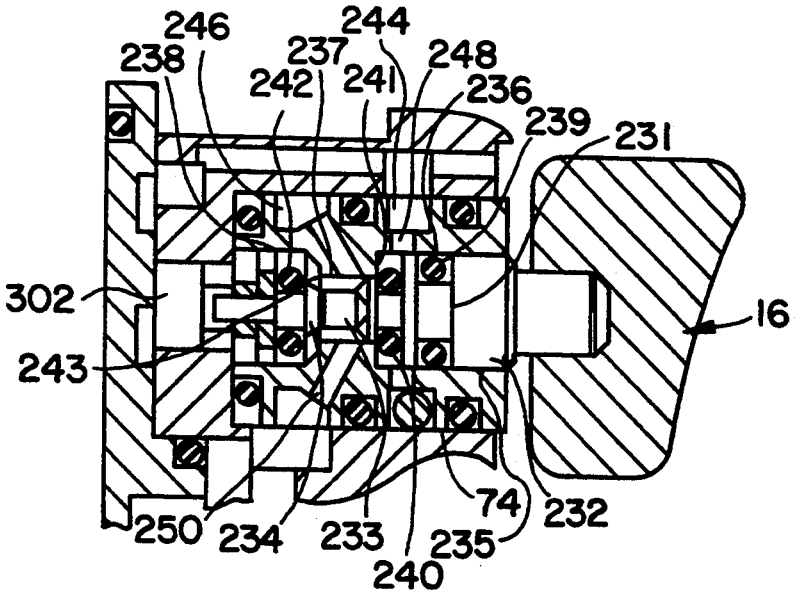
FIG. 2A is an enlarged view in partial section of the poppet valve assembly used in the Finger actuated valve.

The construction of finger actuated valve assembly 16 is shown in FIG. 2A. Note that it is similar to the construction of thumb actuated valve assembly 18 shown in FIG. 4. Because of the similarity, the last two digits of the reference numbers are used to define the same parts as in valve assembly 18. The only difference is that the first digit of the reference number is a "2" instead of a "1" as used in the specification. Central poppet portion 231 has an upper portion 232, a central portion 233 and a lower portion 234. Central poppet 231 moves within a passageway 235 which has upper portion 236, central portion 237 and lower portion 238.

Surrounding the upper portion 232 of central poppet 231 is o-ring 239 which provides sealing against the walls of upper portion 236 of passageway 235. O-ring 240 provides sealing against shoulder 241 formed between the upper portion 236 of passageway 235 and central portion 237 of passageway 235. O-ring 242 provides sealing against shoulder 233 formed between lower portion 238 of passageway 235 and central portion 237 of passageway 235. Air is allowed to flow within finger actuated valve assembly 16 through annular grooves 244 and 246. Air is provided to exterior of valve assembly 16 through ports 248, 250, and 302.

Control of the speed of the travel of piston 20 within cylinder sleeve 26 and thus the speed of moving blades 92 with respect to stationary blade 94 may be obtained by adjusting optional speed control valve assembly 150. Speed control valve assembly 150 includes a conical needle portion 152 which fits within opening 154. Position of the conical portion 152 with respect to opening 154 is controlled by threadable engagement 156 with a hole formed in the base of pistol grip 67. Air flow is provided to speed control valve assembly through ports 293 and 295.

Operation

The sequence of operation of the valve assembly may be shown in the schematic diagrams, FIGS. 5–13.

Figure 5:
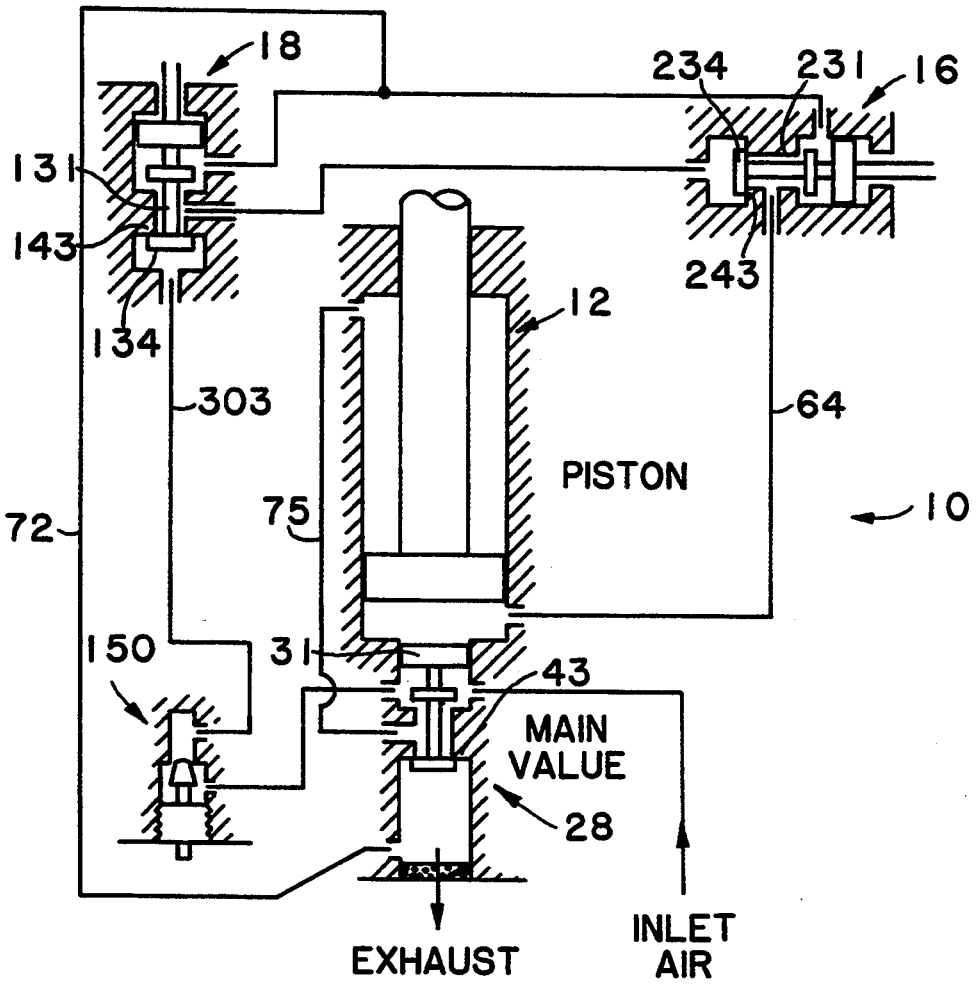
FIG. 5 is a schematic flow diagram of the air logic circuit of the present invention wherein the tool is at rest and neither valve trigger has been depressed.

In FIG. 5, tool 100 is shown at rest with the trigger portions of valve assemblies 16 and 18 not depressed. Piston 20 is at the bottom of cylinder sleeve 26. Main valve assembly 28 is in its uppermost position. The lower portion 34 of central poppet 31 seals against shoulder 43. Air flows past the central portion 33 of poppet assembly 31 and into speed control valve assembly 150. From there, the air enters thumb actuated valve assembly 18 after going through passage 303. Air flow is blocked by the engagement of the lower portion 134 of the poppet assembly 131 with shoulder 143. Similarly, in the finger activated valve assembly 16, the passage of air is blocked by engagement of the lower portion 234 of the central poppet 231 with shoulder 243.

Figure 6:
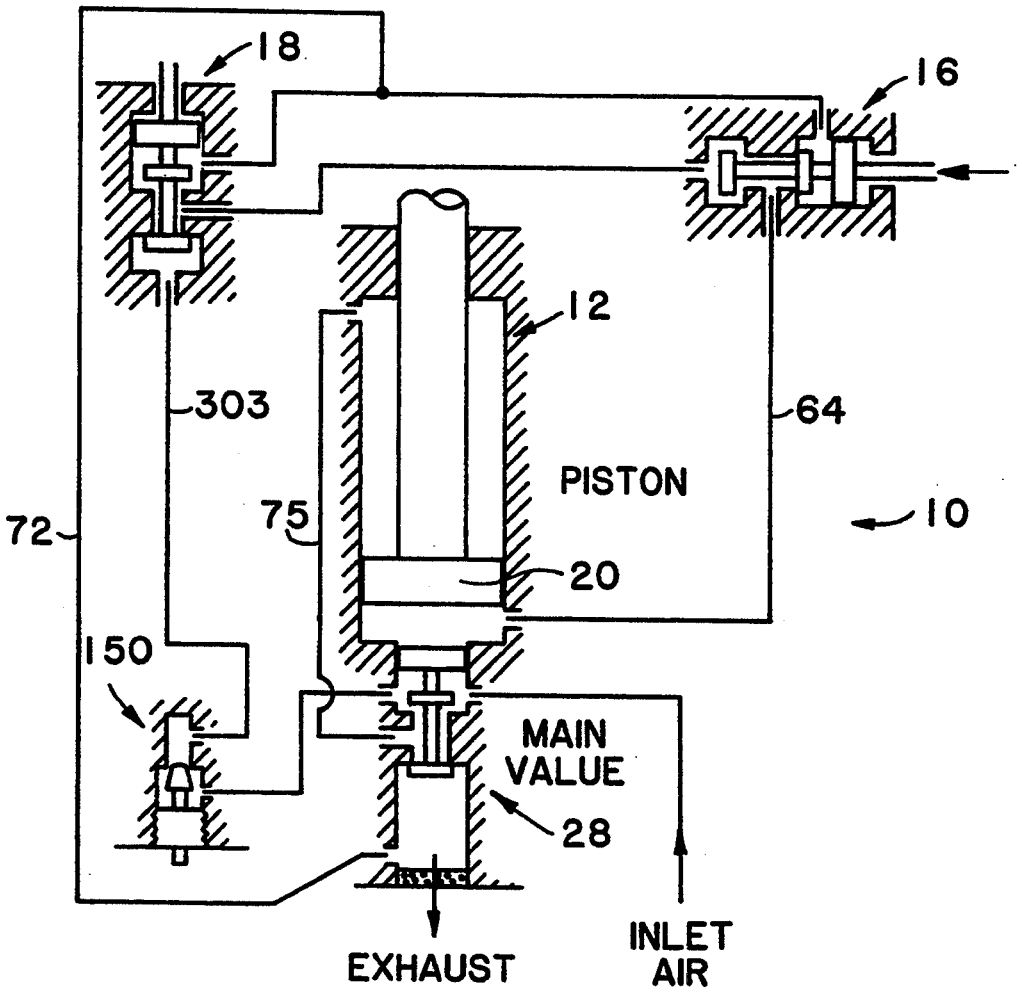
FIG. 6 is a schematic diagram showing only the trigger on the finger actuated valve depressed.

In FIG. 6, only the position of finger actuated valve assembly 16 has changed. Inlet air now flows around main valve assembly 28, and speed control valve assembly 150 as before, but is still blocked by thumb actuated valve assembly 18. Passage of air into the space under piston 20 would be permitted by finger valve assembly 16 were flow not blocked by thumb valve assembly 18.

Figure 7:
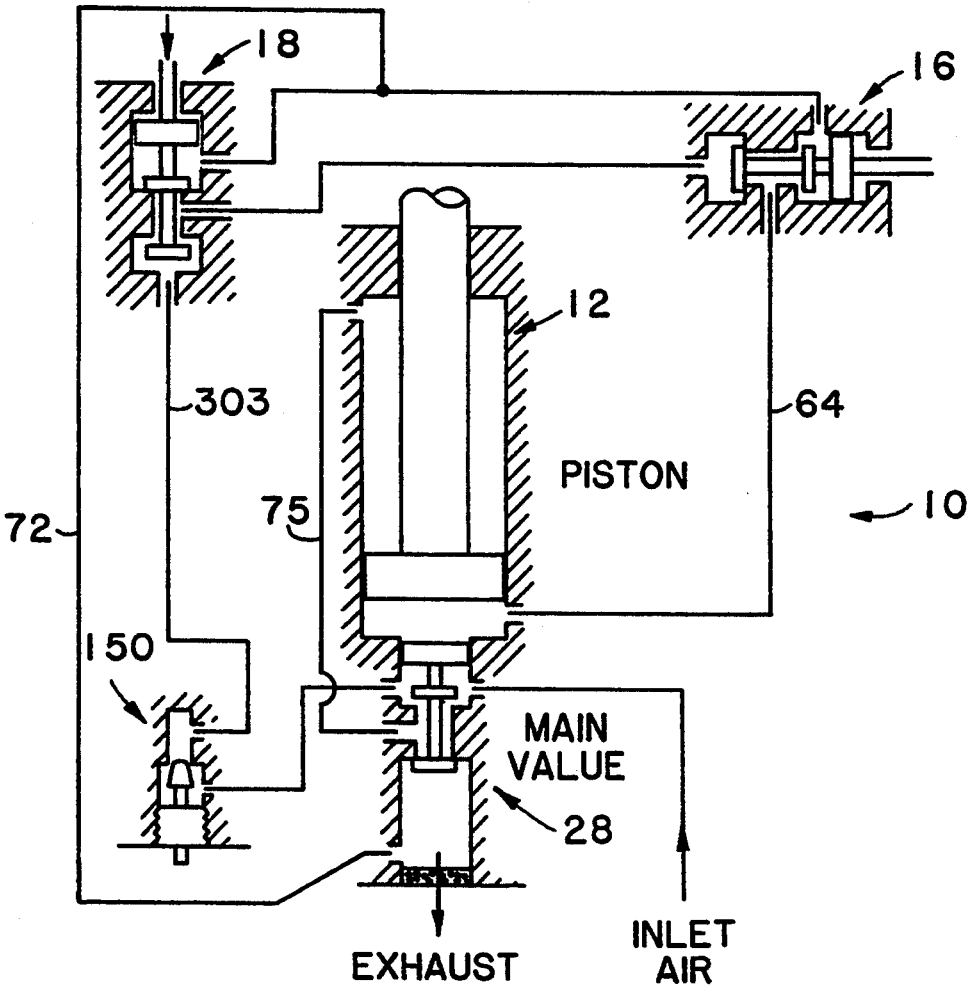
FIG. 7 is a schematic diagram showing only the trigger on the thumb actuated valve depressed.

In FIG. 7, the analog of the situation shown in FIG. 6 is shown. Thumb actuated valve assembly 18 is pressed, but finger valve assembly 16 is not pressed. Air flows around main valve assembly 28, through speed control valve assembly 150 through thumb actuated valve assembly 18 after flowing through passage 303, but flow is blocked by finger actuated valve assembly 16.

The combination of FIGS. 5, 6 and 7 illustrate a key operational feature of the present invention. In order for the power operated shears 100 of the present invention to work, it is necessary to depress both finger actuated valve assembly 16 and thumb actuated valve assembly 18. By only depressing the finger actuated valve assembly 16 or thumb actuated valve assembly 18, blade 92 will not move. The series flow connection of main valve assembly 28, finger actuated valve assembly 16 and thumb actuated valve assembly 18 prevents operation unless air is allowed to flow through all three valve assemblies. This requirement for actuating both valve assemblies 16 and 18 is a safety feature which prevents the inadvertent activation of the shears by depressing only one valve.

Figure 8:
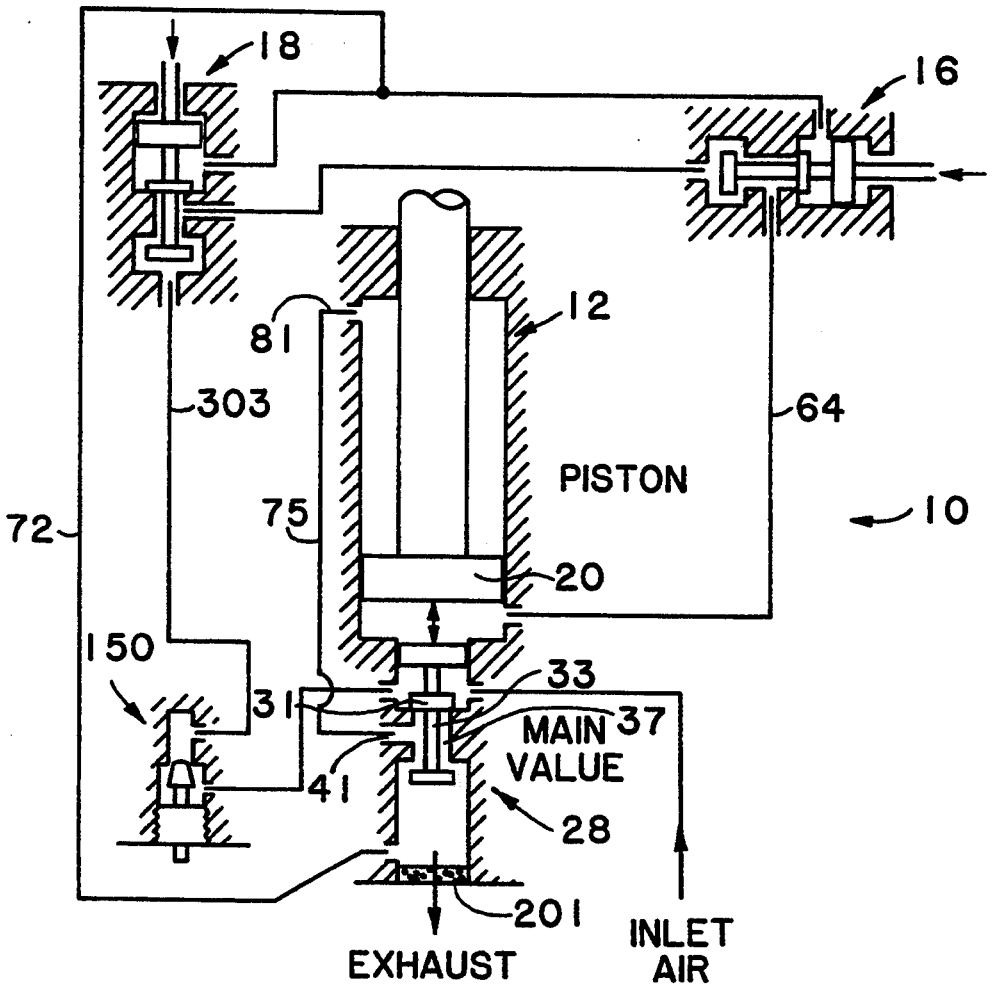
FIG. 8 is a schematic of the air logic diagram showing the triggers on both the finger and thumb actuated valves depressed.

In FIG. 8, both valve assemblies 16 and 18 are depressed. High-pressure inlet air passes around main valve assembly 28, speed control valve assembly 150 and thence through thumb actuated valve assembly 18. Flow through thumb actuated valve assembly 18 then passes through finger actuated valve assembly 16 and into the space beneath piston 20. Piston 20 is forced upward; central poppet 31 of main valve assembly 28 is simultaneously forced downward. The downward motion of poppet 31 causes sealing of the central portion 33 against shoulder 41. As piston 20 moves upward within cylinder 26, air exits through port 81 on the top of cylinder sleeve 26 and passes downward through passage 75. Air is exhausted from tool 100 by passing around central portion 33 of poppet 31 and thence outward through central portion 37 and lower portion 38 of passageway 35. The sound of exhaust air is muffled by muffler piece 201.

Figure 9:
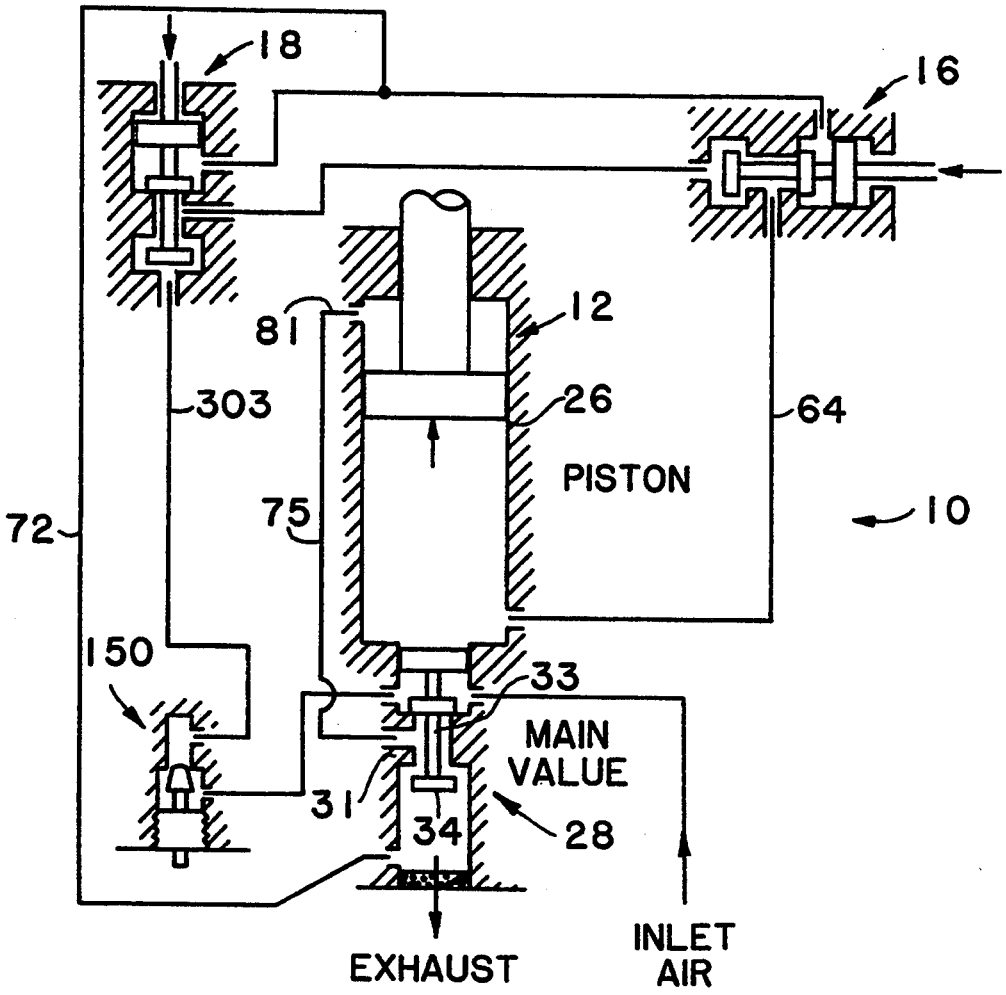
FIG. 9 is a schematic air logic diagram showing the triggers on both the finger and thumb activated valves depressed and the blades completely closed.

As may be seen in FIG. 9, piston 20 has moved to the top of cylinder sleeve 26. Air flow continues as shown in FIG. 8, that is, high-pressure inlet air flows around main valve assembly 28, through speed control valve assembly 150 through thumb actuated valve assembly 18, thence through finger actuated valve assembly 16 and to the bottom of piston 20. The air above piston 20 exits out the top of cylinder sleeve 26 through port 81, down air passage 75, through port 80 and out around the lower portion 34 and central portion 33 of poppet 31. As long as both finger actuated valve assembly 16 and thumb actuated valve assembly 18 remain depressed, piston 20 will stay at the top of its stroke and blade assembly 90 remains closed.

Figure 10:
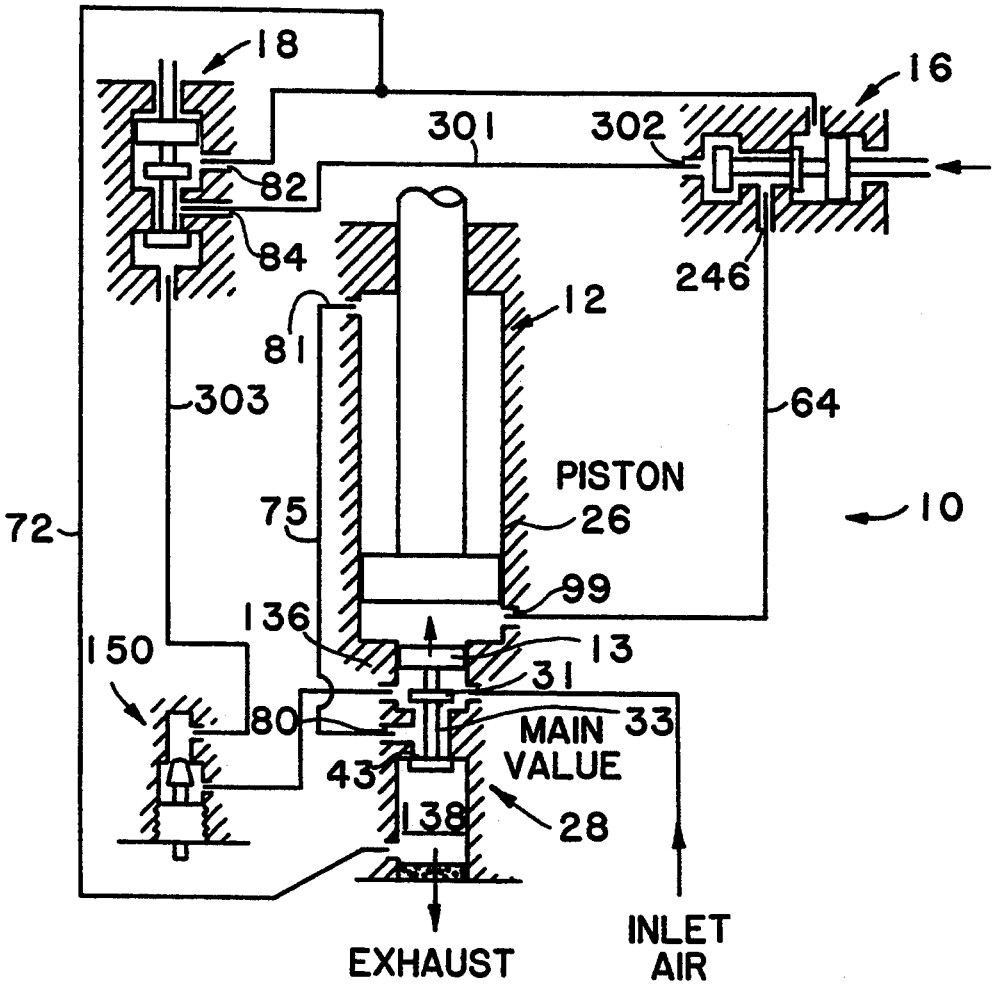
FIG. 10 is a schematic diagram showing the condition when the trigger on the thumb actuated valve has been released and the blades are returning to their open position.
Figure 11:
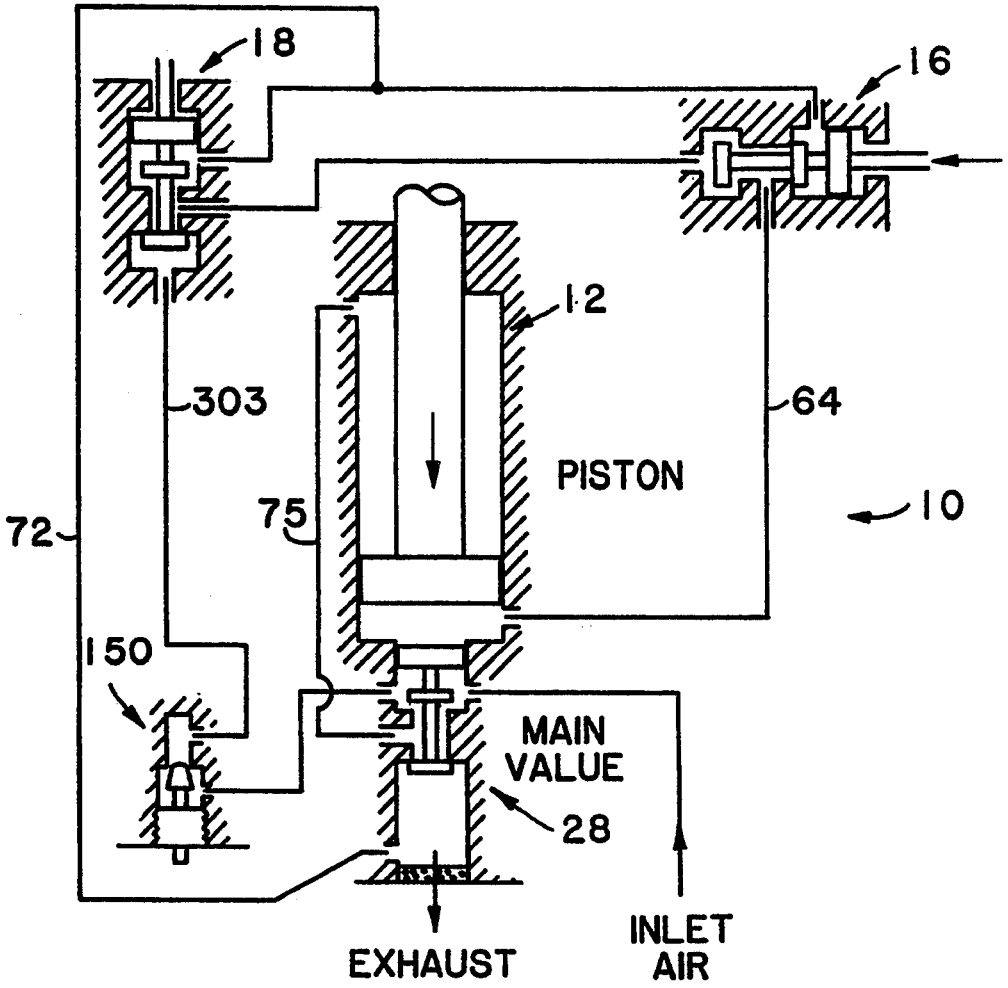
FIG. 11 is a schematic diagram of the air logic circuit of the present invention where the trigger on the thumb actuated valve has been released and the blades have been fully opened.

In FIG. 10, blades 92 and 94 in blade assembly 90 are closed. Releasing pressure from thumb actuated valve assembly 18 allows high-pressure air in chamber 136 to force poppet 131 outward, thus making fluid connection of the space in the cylinder 26 beneath piston 20 with exhaust chamber 138, causing the following to happen. High-pressure air beneath piston 20 exists cylinder 26 through port 99, up passage 64, through port 246, through finger valve 16, out port 302, around groove 301 to port 84, through thumb valve 18, out port 82, down passage 72 through exhaust muffler 201. The evacuation of high-pressure air beneath piston 20 causes poppet 31 of main valve 28 to move upward, sealing on shoulder 43, thus directing high-pressure inlet air around central portion 33, out port 80, up passage 75, in port 81 to topside of piston 20. High-pressure air continues to flow to the topside of piston 20 until the piston reaches the end of the stroke, at which time the blades are completely opened and air flow stops, as shown in FIG. 11, with high-pressure air mounted on topside of piston 20.

Figure 12:
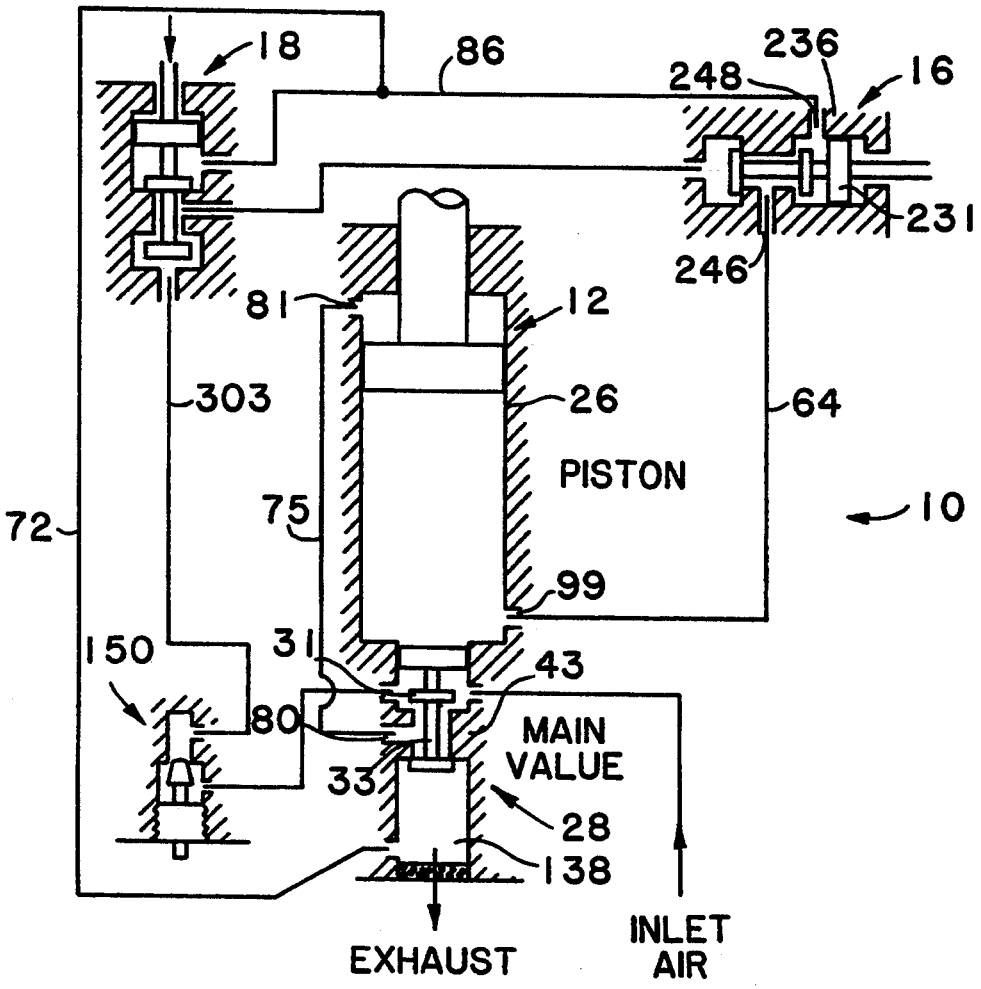
FIG. 12 is a schematic of the air logic circuit of the present invention where the trigger on the finger actuated valve has been released and the blades are returning to their open position.
Figure 13:
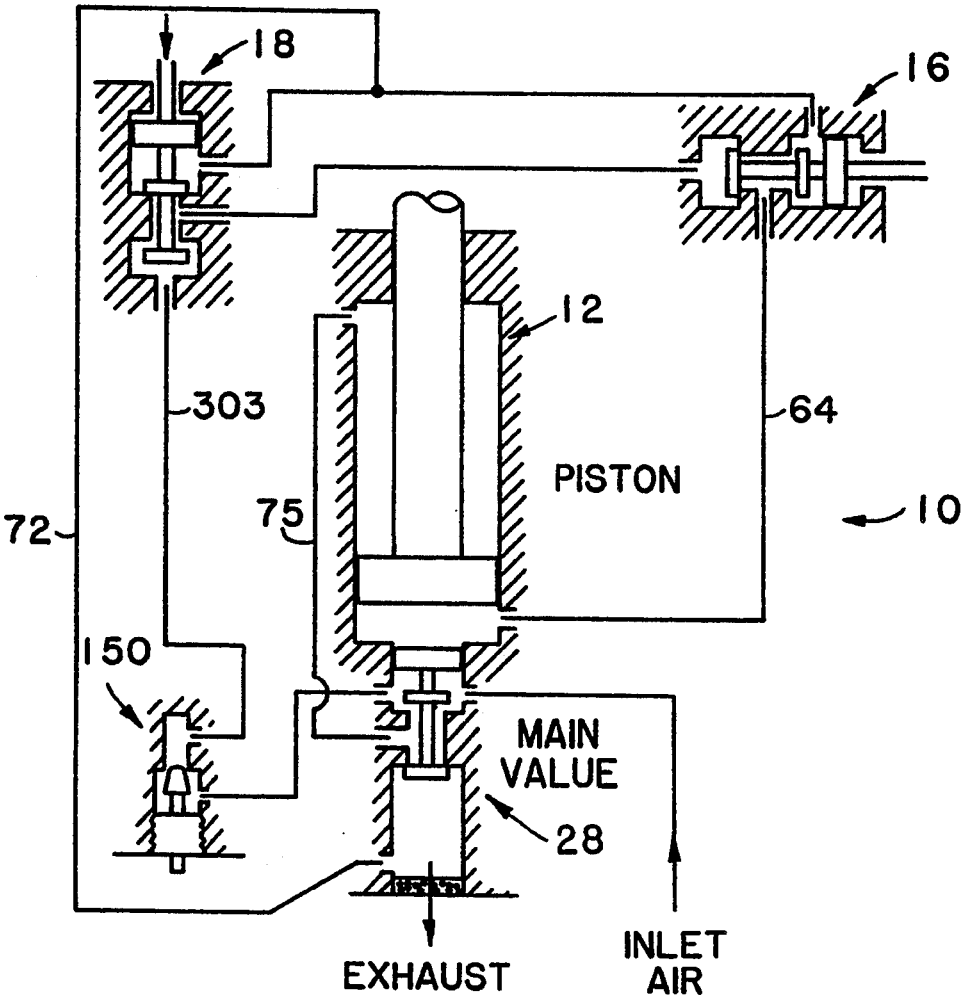
FIG. 13 is a schematic view of the air logic circuit of the present invention where the trigger on the finger actuated valve has been released and the blades have been fully opened.

In FIGS. 12 and 13, an alternate closing method is shown. These figures are analogs of FIGS. 10 and 11.

Specifically, in FIG. 12, blades 92 and 94 are closed. Releasing pressure from finger actuated valve assembly 16 allows high pressure air in chamber 236 to force poppet 231 outward, thus making fluid connection of the space in cylinder 26 beneath piston 20 with exhaust chamber 138, causing the following to happen. High-pressure air beneath piston 20 exists cylinder 26 through port 99, up passage 64, through port 246, through finger valve assembly 16, out port 248, around annular groove 86 to air passage 72, through exhaust muffler 201. The evacuation of high-pressure air beneath piston 20 causes poppet 31 of main valve to move upward, sealing on shoulder 43, thus directing high-pressure inlet air around central portion 33, out port 80, up passage 75, in port 81 to topside of piston 20. High-pressure air continues to flow to the topside of piston 20 until the piston reaches the end of the stroke, at which time the blades are completely opened and air flow stops, as shown in FIG. 13, with high-pressure air mounted on topside of piston 20.

It may be seen from a review of FIGS. 8–13 that once again the safety feature of utilizing interconnecting valve assemblies to operate the shears of the present invention is shown. Release of pressure on either valve assembly 16 or 18 will cause the piston 20 to travel downward within cylinder sleeve 26, thus causing the shears to open. It is only through activation of both valve assembly 16 and 18 that the shears will close. Control of the speed of opening and closing of the shears is accomplished by adjustment of speed control valve assembly 150 by turning screwhead 98.

There is thereby shown by the air flow control system 10 of the present invention a method for providing safe operation of pneumatically controlled shears 100.

While the system has been illustrated utilizing inlet air passing through speed control valve assembly 150 to control the upward stroke of piston 20 for controlling the closing speed of blades, it will be understood that speed control valve assembly 150 can be located in the system to control the flow of exhaust air rather than the flow of supply air.

In either case, the placement of the speed control valve assembly 150 will control only the closing speed of the blades, while the opening speed of the blades is unrestricted and non-variable.

Worthy of further notice is the placement of the finger actuated valve assembly 16 and thumb actuated valve assembly 18. These two valve assemblies are located in different planes suitable for comfortable use with the human hand. Because of the construction of the pneumatic control valve assembly of the present invention, the operator is not forced to use the thumb or the finger repetitively to open and close the scissors. The thumb or the finger may be alternately be used thus relieving fatigue on the muscles which control the operator's fingers. The placement of valve assemblies 16 and 18 is complimented by the ergonomic shape of pistol grip 67.

Those of ordinary skill in the art will understand that numerous embodiments of the invention disclosed herein are possible. Such other embodiments shall fall within the scope of the appended claims.

We claim:

1. A pneumatic power unit for single stroke tools comprising:

a piston and cylinder assembly;

a control system for said piston and cylinder assembly including:

a main valve;

a first remote valve constructed and arranged for finger actuation;

a second remote valve constructed and arranged for thumb actuation;

said first and second valves being positioned relative to each other such that both valves can be actuated with a single hand;

said first remote valve, said second remote valve and said main valve fluidically interconnected to each other such that the power unit is activated by either simultaneously or sequentially actuating both the first and second remote valves and deactivated by releasing either the first or second remote valve.

2. The system as defined in claim 1 further including a speed control valve assembly.

3. The system as defined in claim 2 wherein said speed control valve assembly is a variable air inlet valve.

4. The system as defined in claim 2 wherein said speed control valve assembly is a variable air exhaust valve.

5. The system as defined in claim 1 wherein said valves are poppet valves.

6. The system as defined in claim 5 wherein said poppet valves are three-way valves.

7. A pneumatic power unit for a single-stroke tool comprising:

a main valve;

a first poppet valve fluidically interconnected with said main valve;

a second poppet valve fluidically interconnected with said first poppet valve;

a cylinder and piston assembly, said cylinder and piston assembly being fluidically interconnected with said second valve assembly;

whereby inlet air moves said piston in a first direction within said cylinder after passing through said first poppet valve and said second poppet valve, and inlet air shifts said main valve, such that release of either poppet valve allows the inlet air to move said piston in a second direction.

8. The unit as defined in claim 7 further including a variable speed control valve.

9. The unit as defined in claim 8 wherein said variable speed control valve is a variable air inlet valve.

10. The unit as defined in claim 8 wherein said variable speed control valve is variable air exhaust valve.

* * * * *